US005793273A

United States Patent [19]

Yamaguchi et al.

[11] Patent Number: 5,793,273

[45] Date of Patent: Aug. 11, 1998

[54] CHOKE COIL FOR SUPPRESSING COMMON-MODE NOISE AND NORMAL-MODE NOISE

[75] Inventors: Kouichi Yamaguchi, Fukui-ken; Takaaki Ooi, Takofu; Tatsuyuki Yamada, Fukui-ken, all of Japan

[73] Assignee: Murata Manufacturing Co., Ltd., Nagaokakyo, Japan

[21] Appl. No.: 858,371

[22] Filed: May 19, 1997

[30] Foreign Application Priority Data

May 20, 1996 [JP] Japan ..... 8-124812

[51] Int. Cl.[6] ..... H01F 27/06; H01F 27/30; H01F 27/24

[52] U.S. Cl. ..... 336/198; 336/208; 336/214; 336/65; 336/212

[58] Field of Search ..... 336/212, 214, 336/215, 208, 198, 65

[56] References Cited

U.S. PATENT DOCUMENTS 4,924,200 5/1990 Kitahara et al. ..... 336/65
4,945,332 7/1990 Sakamoto et al. ..... 336/198
5,635,891 6/1997 Miyoshi et al. ..... 336/90

FOREIGN PATENT DOCUMENTS 7-106140 4/1995 Japan ..... 336/198

*Primary Examiner*—Michael L. Gellner
*Assistant Examiner*—Anh Mai
*Attorney, Agent, or Firm*—Burns, Doane, Swecker & Mathis, LLP

[57] ABSTRACT

A choke coil exhibits sufficient capability in suppressing both common-mode noise and normal-mode noise while inhibiting an occurrence of magnetic saturation of a magnetic core. A terminal stand is formed of a frame and a magnetic plate. A split-type bobbin has a bobbin member made from a magnetic substance and a bobbin member made from an insulating substance. The bobbin is formed of a rod and three flanges provided for the rod. A pair of windings are reeled around the rod of the bobbin. Further, one side of an integral-type magnetic core formed in a hollow-rectangular shape is inserted into a hole formed in the rod of the bobbin. The magnetic bobbin member is placed outside a region surrounded by a closed magnetic path formed by the magnetic core. The magnetic bobbin member also forms a closed magnetic path together with the magnetic plate of the terminal stand.

1 Claim, 6 Drawing Sheets

CHOKE COIL FOR SUPPRESSING COMMON-MODE NOISE AND NORMAL-MODE NOISE

BACKGROUND OF THE INVENTION

This application corresponds to Japanese Patent Application No. 8-124812, filed May 20, 1996, which is hereby incorporated by reference in its entirety.

1. Field of the Invention

The present invention relates generally to choke coils and, more particularly, to a choke coil used for suppressing noise generated in or entering electronic equipment.

2. Description of the Related Art

Typically, since a common-mode choke coil has a slight leakage inductance component in its normal mode (i.e. differential mode), it is effective against normal-mode noise, as well as against common-mode noise. If, however, the normal-mode noise is too high, a normal-mode choke coil should be independently used to reduce such noise.

Moreover, in a common-mode choke coil having a comparatively large amount of normal-mode leakage inductance, leakage magnetic flux may sometimes produce an adverse influence on peripheral circuits. In this case, it is necessary to apply a magnetic shield to the periphery of the common-mode choke coil.

In order to effectively reduce both common-mode noise and normal-mode noise, a common-mode choke coil disclosed in Japanese Unexamined Patent Publication No. 7-106140 has been proposed.

This common-mode choke coil, however, encounters the following problems. The choke coil has a somewhat low capability of suppressing common-mode noise because a completely closed magnetic path is less likely to be formed because of the use of a non-integral-type magnetic core. Further, if a magnetic core is placed in proximity with a magnetic-substance-formed frame, it is likely that the magnetic flux circulating around the periphery of the frame will partially leak and enter the magnetic core, thus causing magnetic saturation of the core. This may completely eliminate the capability of suppressing common-mode noise.

SUMMARY OF THE INVENTION

Accordingly, it is an exemplary object of the present invention to provide a choke coil having a sufficient capability of suppressing both common-mode noise and normal-mode noise while reducing an occurrence of magnetic saturation of a magnetic core.

In order to achieve the above object, there is provided a choke coil comprising:

(a) a pair of windings;

(b) a split-type bobbin formed of an insulating member and a magnetic member and having a cylindrical rod around which the pair of windings are reeled and at least one flange extending from the cylindrical rod;

(c) an integral-type magnetic core having a side which is inserted into a hole formed in the cylindrical rod, and forming a closed magnetic path; and (d) a terminal stand for supporting the split-type bobbin and forming a closed magnetic path together with the magnetic member of the split-type bobbin. The magnetic member of the split-type bobbin is disposed outside a region surrounded by the closed magnetic path formed by the magnetic core.

With the above construction, when common-mode noise currents flow in a pair of windings, magnetic flux is generated in the windings. The components of magnetic flux generated in the windings are combined and converted into thermal energy in the form of eddy current loss, and then attenuated in the magnetic core which forms a closed magnetic path. Accordingly, the common-mode noise currents are reduced. At this time, the common-mode inductance is increased because the magnetic core is an integral type core.

In contrast, when a normal-mode noise current flows in a pair of windings, magnetic flux is generated in the windings. The magnetic flux is converted into thermal energy in the form of eddy current loss and is attenuated while circulating in a closed magnetic path formed by the magnetic bobbin member and the terminal stand. Accordingly, the normal-mode noise current is suppressed. The magnetic bobbin member is located outside the region surrounded by the closed magnetic path formed by the integral-type magnetic core, thereby ensuring a wide spacing between the closed magnetic path formed by the magnetic bobbin member and the terminal stand and the closed magnetic path formed by the magnetic core. This can impede entrance of the magnetic flux circulating in the closed magnetic path formed by the magnetic bobbin member and the terminal stand to the magnetic core. As a result, an occurrence of magnetic saturation of the magnetic core can be inhibited.

BRIEF DESCRIPTION OF THE DRAWINGS

FIGS. 6A and 6B illustrate the common-mode noise suppressing operation performed by the choke coil shown in FIG. 1, wherein FIG. 6A is a magnetic circuit diagram and FIG. 6B is an electrical circuit diagram;

FIGS. 7A and 7B illustrate the normal-mode noise suppressing operation performed by the choke coil shown in FIG. 1, wherein FIG. 7A is a magnetic circuit diagram and FIG. 7B is an electrical circuit diagram;

DESCRIPTION OF THE PREFERRED EMBODIMENTS

Figure 1:
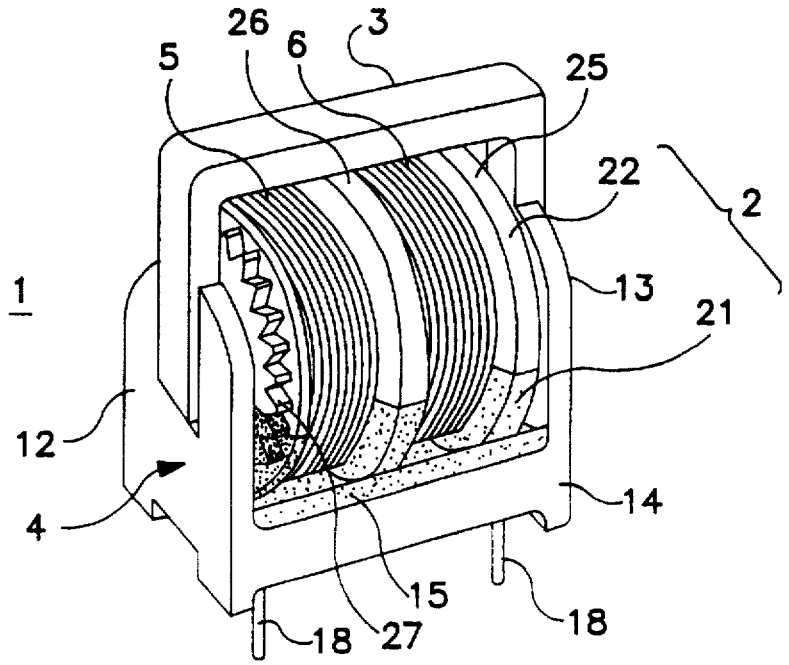
FIG. 1 is a perspective view illustrating a choke coil according to a first embodiment of the present invention.

A description will now be given of exemplary embodiments of the present invention with reference to the accompanying drawings. In the respective exemplary embodiments, the same elements and the same portions are designated by like reference numerals.

First Embodiment (FIGS. 1–7)

A choke coil generally indicated by 1 is formed, as illustrated in FIG. 1, of a split-type bobbin 2, an integral-type magnetic core 3, a terminal stand 4, and a pair of windings 5 and 6.

Figure 2:
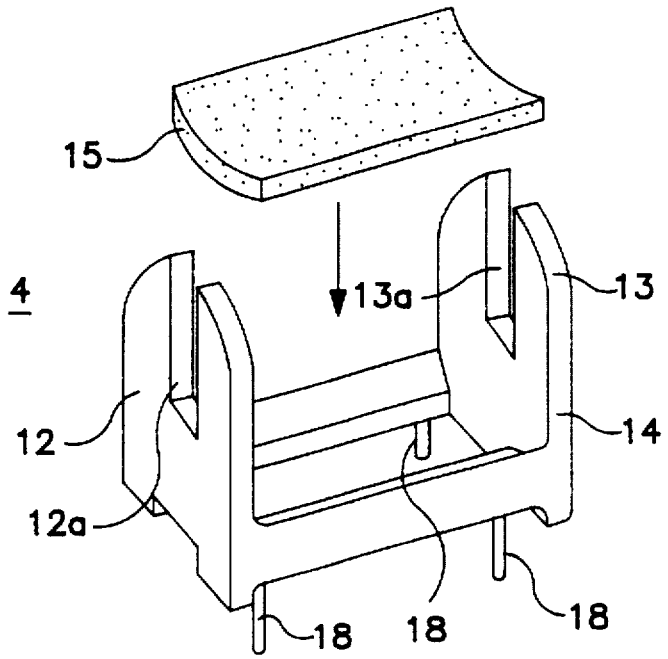
FIG. 2 is a perspective view illustrating an assembly operation of a terminal stand used in the choke coil shown in FIG. 1.

The terminal stand 4 is formed, as illustrated in FIG. 2, of a frame 14 having notches 12*a* and 13*a* on the respective left and right lateral surfaces 12 and 13, and a magnetic plate 15. Terminals 18 are respectively embedded into the four corners of the bottom surface of the frame 14. The top surface of the magnetic plate 15 is curved in a recessed shape.

Figure 3:
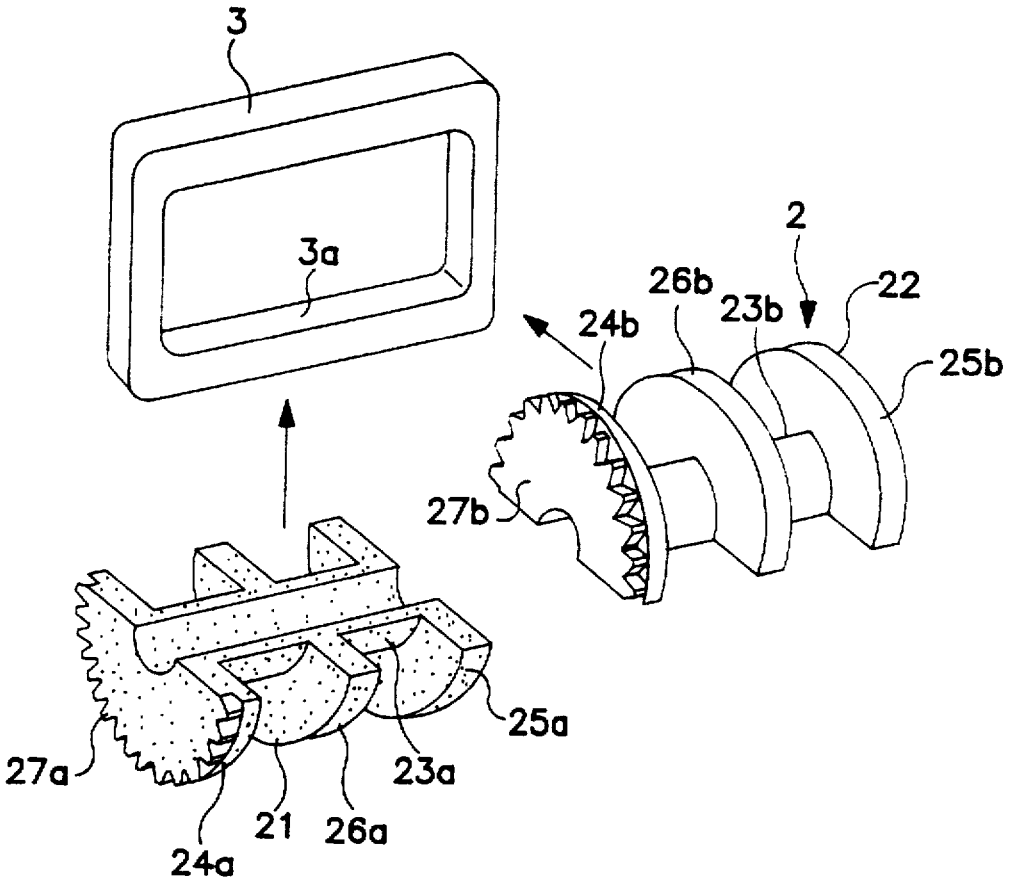
FIG. 3 is a perspective view illustrating an assembly operation of a split-type bobbin and an integral-type magnetic core used in the choke coil shown in FIG. 1.

The split-type bobbin 2 is comprised, as shown in FIG. 3, of bobbin members 21 and 22 which have been split in a direction parallel to the axis of the bobbin 2. The bobbin member 21 has a semi-cylindrical rod-like portion 23*a* and semi-disc-shaped flange portions 24*a*, 25*a*, 26*a*. The flange portions 24*a* and 25*a* are disposed at both opposite ends of the rod-like portion 23*a* and the flange portion 26*a* is provided approximately at the center of the portion 23*a*. Similarly, the bobbin member 22 has a semi-cylindrical rod-like portion 23*b* and semi-disc-shaped flange portions 24*b*, 25*b* and 26*b*. The flange portions 24*b* and 25*b* are disposed at opposite ends of the rod-like portion 23*b* and the flange portion 26*b* is provided approximately at the center of the rod-like portion 23*b*. Semi-circular gear members 27*a* and 27*b* are respectively formed on the left lateral surfaces of the flange portions 24*a* and 24*b*.

As the material for the bobbin member 21, as well as for the magnetic plate 15 of the terminal stand 4, a magnetic material having a relative magnetic permeability of approximately 1 or greater (for example, 2 to several dozen (e.g. 30)) is used. More specifically, a material produced by kneading materials such as Ni—Zn or Mn—Zn ferrite powder, or like materials, and a resin binder may be used. An insulating material is employed as the material for the bobbin member 22, as well as the material for the frame 14 of the terminal stand 4. More specifically, a polybutylene terephthalate resin, a polyphenylene sulfide resin, a polyethylene terephthalate resin, or like material may be used. As the material for the integral-type magnetic core 3 having a hollow-rectangular shape, a material having a relative magnetic permeability of several thousands, such as ferrite or amorphous material, may be preferably employed.

The bobbin members 21 and 22 constructed as described above are mechanically fitted together and/or are bonded together with an adhesive. More specifically, the bobbin members 21 and 22 clamp one side 3*a* of the magnetic core 3 between the rod-like portions 23*a* and 23*b*, thereby forming the bobbin 2. Since the bobbin 2 is not formed entirely from an expensive magnetic material, the manufacturing cost can be reduced as compared with conventional bobbins.

Figure 4:
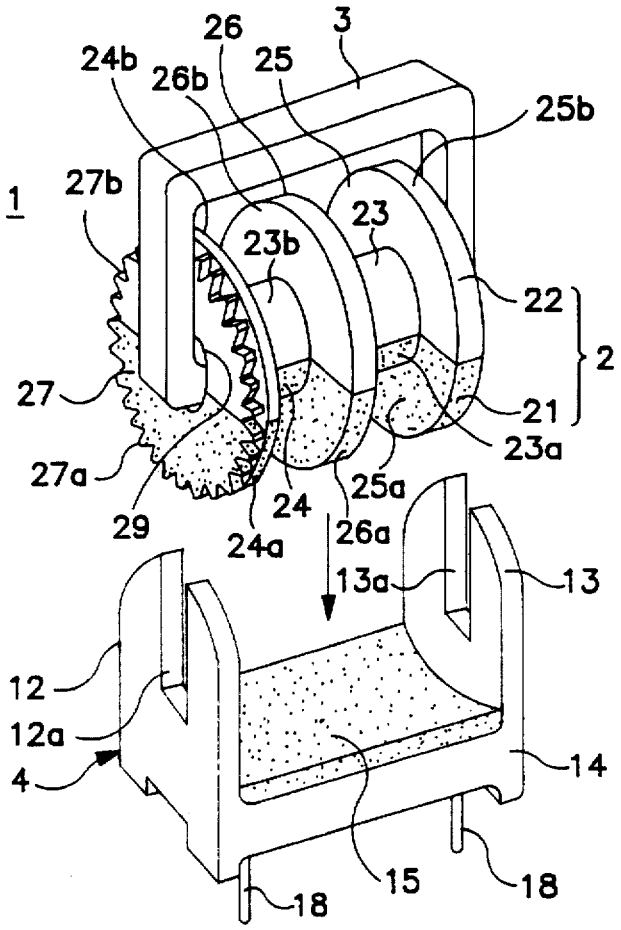
FIG. 4 is a perspective view illustrating an assembly operation of the terminal stand shown in FIG. 2 and the split-type bobbin and the integral-type magnetic core shown in FIG. 3.

Thus, by fitting the bobbin members 21 and 22 together, the bobbin 2 has, as shown in FIG. 4, a cylindrical rod 23 formed of the semi-cylindrical rod-like portions 23*a* and 23*b*, and disc-like flanges 24, 25 and 26 respectively formed of semi-disc-like flange portions 24*a* and 24*b*, 25*a* and 25*b*, and 26*a* and 26*b*. A hole 29 formed in the cylindrical rod 23 is circular in cross section. However, the hole may be formed in another shape, such as a rectangle. The gear members 27*a* and 27*b* can be formed into a round circular gear 27.

Next, the bobbin 2 integrated with the magnetic core 3 is fit into the terminal stand 4. Namely, the magnetic core 3 is fit into the notches 12*a* and 13*a* of the terminal stand 4, so that the flanges 24, 25 and 26, and particularly the outer peripheral surfaces of the semi-circular flange portions 24*a*, 25*a* and 26*a* of the magnetic bobbin member 21, are made to abut against the recessed curved surface of the magnetic plate 15. As a consequence, a closed magnetic path can be formed by the bobbin member 21 and the magnetic plate 15. It should be noted that the outer peripheral surfaces of the flange portions 24*a*, 25*a* and 26*a* of the bobbin member 21 and the magnetic plate 15 may be bonded with an adhesive, or other suitable bonding technique, as required.

Then, after the leading ends of the respective windings 5 and 6 are fixed on two of the terminals 18, a gear wheel (not shown) is meshed with the gear 27. A rotating force is then provided to rotate the bobbin 2 about the side 3*a* of the magnetic core 3, thereby reeling the windings 5 and 6 around the rod 23. When the windings 5 and 6 are completely reeled, the trailing ends of the windings 5 and 6 are respectively fixed to the remaining two terminals 18, thereby establishing electrical connection between the windings 5 and 6 and the four terminals 18. As a consequence, the choke coil shown in FIG. 1 can be obtained. The magnetic bobbin member 21 is placed outside the region surrounded by the closed magnetic path formed by the magnetic core 3. In the above embodiment, the windings 5 and 6 are coiled around the bobbin 2 after the bobbin 2 has been fit into the terminal stand 4. This is not, however, the only way to perform this function; other methods may be employed. For example, the windings 5 and 6 may be coiled around the bobbin 2 in advance, and then the bobbin 2 may be fit into the terminal stand 4. In this embodiment, the gear 27 is not required.

Figure 5:
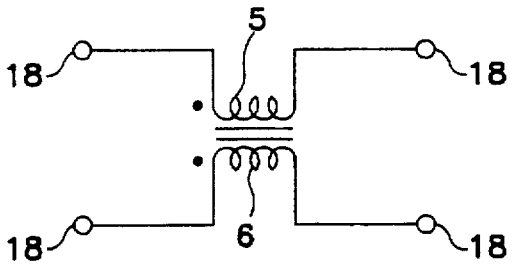
FIG. 5 is a diagram illustrating an electrical equivalent circuit of the choke coil shown in FIG. 1.

FIG. 5 is a diagram illustrating an electrical equivalent circuit of the choke coil 1. An explanation will first be given of the common-mode noise suppressing function of the choke coil 1 constructed as described above while referring to FIGS. 6A and 6B.

Figure 6A:
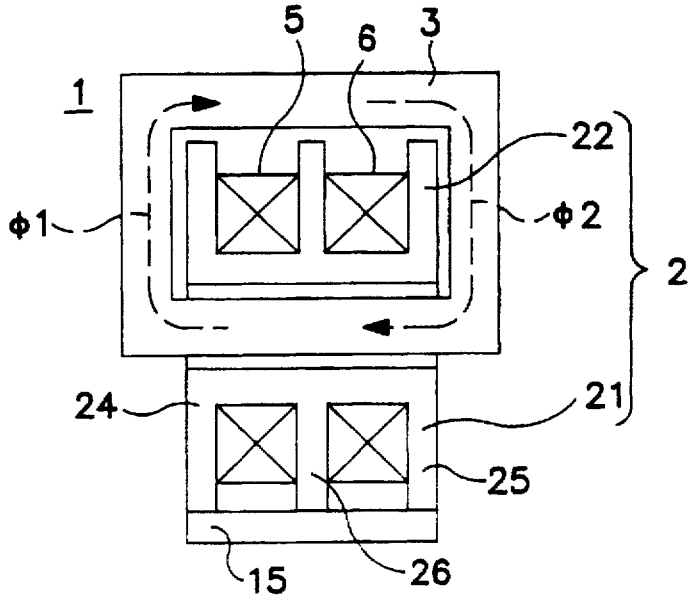
Figure 6B:
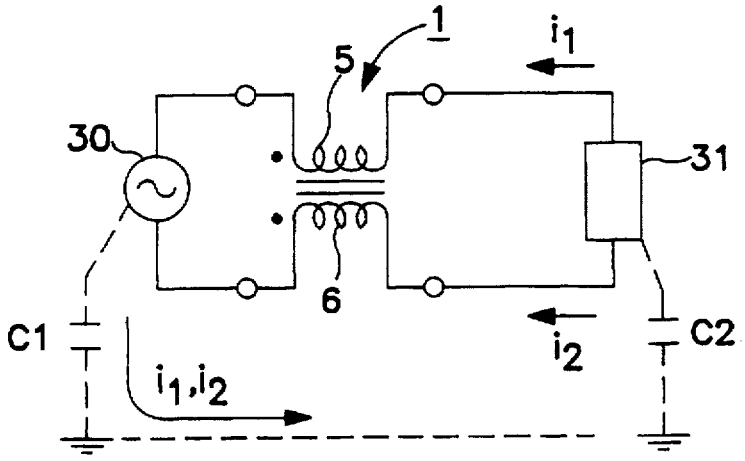

The choke coil 1 is electrically connected, as illustrated in FIG. 6B, to two signal lines disposed between a power source 30 and a load 31, such as some type of electronic equipment. A stray capacitance C1 is generated between the power source 30 and a ground, while a stray capacitance C2 is produced between the load 31 and a ground. When common-mode noise currents $i_1$ and $i_2$ flow in the respective signal lines as indicated by the arrows shown in FIG. 6B, two sets of magnetic flux σ1 and σ2 are generated, as shown in FIG. 6A, in the windings 5 and 6. The two sets of magnetic flux σ1 and σ2 are combined to circulate in the closed magnetic path formed in the magnetic core 3 and are progressively attenuated. This is because the magnetic flux σ1 and σ2 is converted into thermal energy in the form of eddy current loss, thereby reducing the common-mode noise currents $i_1$ and $i_2$. Since the magnetic core 3, which is an integral type, forms a completely closed magnetic path, a choke coil 1 having a large common-mode inductance can be obtained. As a consequence, the capability of suppressing common-mode noise can be enhanced.

The normal-mode noise suppressing function of the choke coil 1 will now be explained with reference to FIGS. 7A and 7B.

Figure 7A:
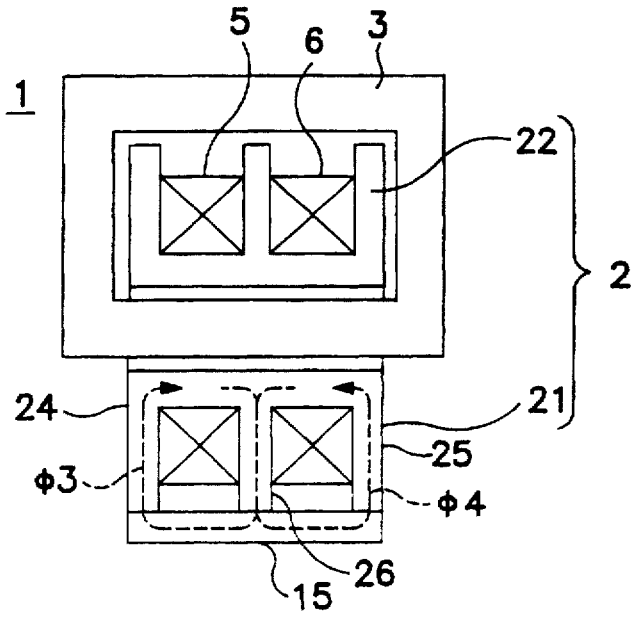
Figure 7B:
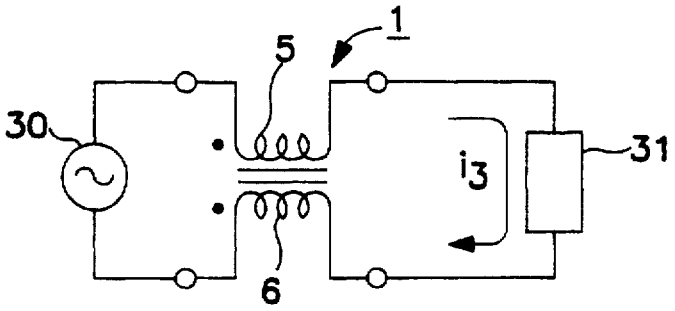

When a normal-mode noise current $i_3$ flows, as shown in FIG. 7B, in the two signal lines as indicated by the arrows shown in the drawing, two sets of magnetic flux σ3 and σ4 are produced, as illustrated in FIG. 7A, in the windings 5 and 6. The sets of magnetic flux σ3 and σ4 are converted into thermal energy in the form of eddy current loss and are progressively attenuated while circulating in the closed magnetic path formed by the bobbin member 21 and the magnetic plate 15. Thus, the normal-mode noise current $i_3$ is reduced. The insulating bobbin member 22 is partially located inside the region surrounded by the closed magnetic path formed by the magnetic core 3, while the magnetic bobbin member 21 is disposed outside the above region. Accordingly, a wide spacing is ensured between the closed magnetic path formed by the bobbin member 21 and the magnetic plate 15 and the closed magnetic path formed by the magnetic core 3. This impedes entrance of the magnetic flux σ3 and σ4 to the magnetic core 3 and further inhibits the magnetic core 3 from being magnetically saturated. Hence, the choke coil 1 can exhibit sufficient performance of suppressing normal-mode noise.

Figure 8:
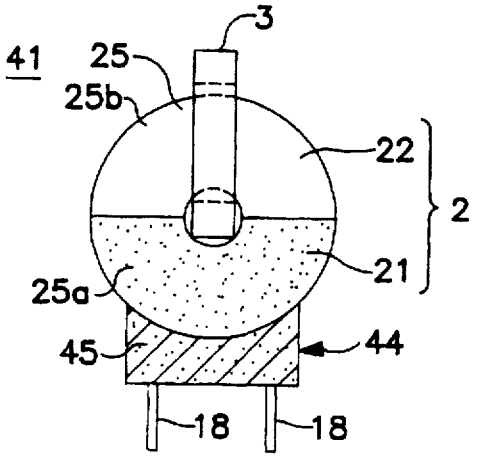
FIG. 8 is a partial-section side view illustrating a choke coil according to a second embodiment of the present invention.

Second Embodiment (FIG. 8)

A choke coil 41 of a second embodiment is similar to the choke coil 1 of the first embodiment, as illustrated in FIG. 8, except for a terminal stand 44. The terminal stand 44 is formed of a frame 45 with a top recessed-curved surface and terminals 18 embedded in the four corners of the bottom surface of the frame 45. As the material for the frame 45, a magnetic material having a relative magnetic permeability of approximately 1 or greater (for example, 2 to several dozens) is used. The peripheral surfaces of the flange portions 24*a*, 25*a* and 26*a* of the bobbin member 21 abut against the recessed-curved surface of the frame 45 (or are bonded with an adhesive, as required) so as to form a closed magnetic path by the bobbin member 21 and the terminal stand 44. The resulting choke coil 41 offers operational characteristics and advantages similar to those achieved by the choke coil 1 of the first embodiment.

Figure 9:
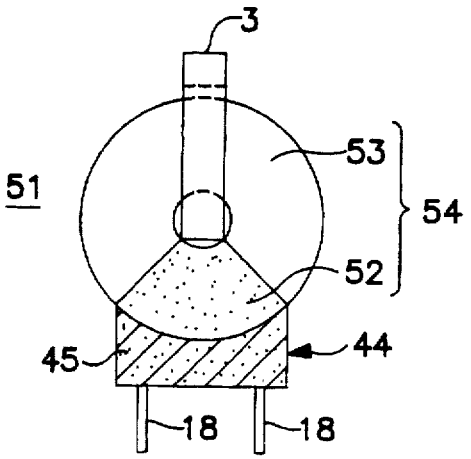
FIG. 9 is a partial-section side view illustrating a choke coil according to a third embodiment of the present invention.
Figure 10:
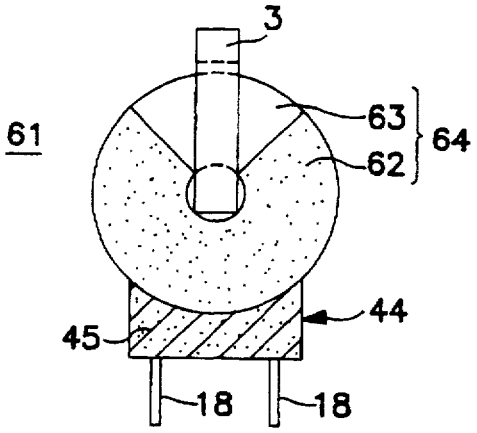
FIG. 10 is a partial-section side view illustrating a choke coil according to a fourth embodiment of the present invention.

Third and Fourth Embodiments (FIGS. 9 and 10) Choke coils 51 and 61 of the respective third and fourth embodiments are similar to the choke coil 41 of the second embodiment, as shown in FIGS. 9 and 10, except for the use of split-type bobbins 54 and 64.

The bobbin 54 of the choke coil 51 of the third embodiment is formed, as illustrated in FIG. 9, of a bobbin member 52 having a rod-like portion and sector-shaped flange portions at a generally 90° angle, and a bobbin member 53 having a rod-like portion and sector-shaped flange portions at a generally 270° angle. The overall configuration of the bobbin 54 is similar to that of the bobbin 2 of the first embodiment. As the material for the bobbin member 52, a magnetic material having a relative magnetic permeability of approximately 1 or greater (for example, 2 to several dozens) is employed. An insulating material is used for the bobbin member 53. The outer peripheral surfaces of the flange portions of the bobbin member 52 abut against the recessed-curved surface of the frame 45 (or are bonded as required), thereby forming a closed magnetic path by the bobbin member 52 and the terminal stand 44.

The bobbin 64 of the choke coil 61 of the fourth embodiment is comprised, as shown in FIG. 10, of a bobbin member 62 including a rod-like portion and flange portions at a generally 270° angle, and a bobbin member 63 having a rod-like portion and flange portions at a generally 90° angle. The overall configuration of the bobbin 64 is similar to that of the bobbin 2 of the first embodiment. As the material for the bobbin member 62, a magnetic material having a relative magnetic permeability of approximately 1 or greater (for example, 2 to several dozens) is employed. An insulating material is used for the bobbin member 63. The outer peripheral surfaces of the flange portions of the bobbin member 62 abut against the recessed-curved surface of the frame 45 (or are bonded as required), thereby forming a closed magnetic path by the bobbin member 62 and the terminal stand 44.

The resulting choke coils 51 and 61 can provide operational characteristics and advantages similar to those offered by the choke coil 1 of the first embodiment.

In the above two embodiments, the angles of the members 52 and 53, and the angles of the members 62 and 63 can assume other values besides 90° and 270°.

Figure 11:
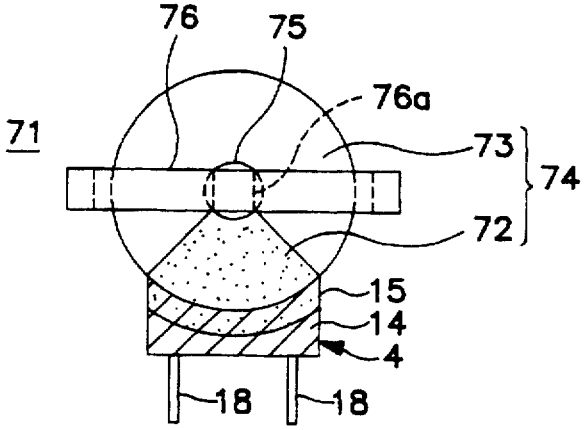
FIG. 11 is a partial-section side view illustrating a choke coil according to a fifth embodiment of the present invention.

Fifth Embodiment (FIG. 11)

A choke coil 71 of a fifth embodiment is similar to the choke coil 1 of the first embodiment, as illustrated in FIG. 11, except for the use of a split-type bobbin 74 and an integral-type magnetic core 76 generally in a shape of two rectangles side by side. The bobbin 74 is formed of a bobbin member 72 having a rod-like portion and flange portions at a generally 120° angle, and a bobbin member 73 including a rod-like portion and flange portions at a generally 240° angle. The overall configuration of the bobbin 74 is similar to that of the bobbin 2 of the first embodiment. As the material for the bobbin member 72, a magnetic material having a relative magnetic permeability of approximately 1 or greater (for example, 2 to several dozens) is employed. An insulating material is used for the bobbin member 73. The outer peripheral surfaces of the flange portions of the bobbin member 72 abut against the recessed-curved surface of the magnetic plate 15 (or are bonded, as required), thereby forming a closed magnetic path by the bobbin member 72 and the magnetic plate 15.

The magnetic core 76 is horizontally placed by inserting a side 76*a* bridging the center of the core 76 into a hole 75 formed in the rod of the bobbin 74. The magnetic bobbin member 72 is located outside the region surrounded by the closed magnetic path formed by the magnetic core 76. Accordingly, a wide spacing is guaranteed between the closed magnetic path formed by the bobbin member 72 and the magnetic plate 15, and the magnetic core 76. With this arrangement, the magnetic core 76 is less likely to be magnetically saturated.

In the above embodiment, the angles of the members 72 and 73 can be varied from their above-stated exemplary values.

Modifications to the Embodiments

The choke coil of the present invention is not restricted to the foregoing embodiments, and may be changed in various ways within the spirit and scope of the invention.

In the aforedescribed embodiments, a pair of windings are split by a partitioning flange (e.g. flange 26) which lies therebetween. However, this is not required, and a pair of windings may be reeled bifilarly around the rod of the bobbin without providing a partitioning flange.

As is seen from the foregoing description, the present invention offers the following advantages.

Since a magnetic core is an integral type, it can form a completely closed magnetic path, thereby reducing leakage magnetic-flux. Thus, a choke coil having a large common-mode inductance can be obtained to enhance the capability of suppressing common-mode noise. Further, the magnetic bobbin member of the split-type bobbin is located outside the region surrounded by the closed magnetic path formed by the integral-type magnetic core, thereby increasing the distance between the closed magnetic path formed by the magnetic bobbin member and the terminal stand, and the magnetic core. This impedes entrance of magnetic flux circulating in the closed magnetic path formed by the magnetic bobbin member and the terminal stand into the magnetic core, thereby further inhibiting an occurrence of magnetic saturation of the magnetic core. Hence, the choke coil of the present invention can exhibit sufficient performance of suppressing common-mode noise.

Additionally, since the bobbin is not wholly formed of an expensive magnetic material but is made of both a magnetic member and an insulating member, the manufacturing cost of the choke coil can be reduced.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. A choke coil comprising:

a pair of windings;

a split-type bobbin formed of an insulating member and a magnetic member and having a cylindrical rod around which said pair of windings are reeled and at least one flange extending from said cylindrical rod;

an integral-type magnetic core having a side which is inserted into a hole formed in said cylindrical rod, and forming a closed magnetic path; and a terminal stand for supporting said split-type bobbin and forming a closed magnetic path together with the magnetic member of said split-type bobbin, wherein the magnetic member of said split-type bobbin is disposed outside a region surrounded by the closed magnetic path formed by said magnetic core.

* * * * *